US010569529B2

(12) United States Patent
Chen et al.

(10) Patent No.: US 10,569,529 B2
(45) Date of Patent: Feb. 25, 2020

(54) SCREEN PRINTING SYSTEM AND CLEANING METHOD THEREOF

(71) Applicants: BOE TECHNOLOGY GROUP CO., LTD., Beijing (CN); Hefei Xinsheng Optoelectronics Technology Co., Ltd., Anhui (CN)

(72) Inventors: Guangfei Chen, Beijing (CN); Qingfeng Jiang, Beijing (CN); Dagang Liu, Beijing (CN)

(73) Assignees: BOE TECHNOLOGY GROUP CO., LTD., Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 234 days.

(21) Appl. No.: 15/785,619

(22) Filed: Oct. 17, 2017

(65) Prior Publication Data

US 2018/0244037 A1 Aug. 30, 2018

(30) Foreign Application Priority Data

Feb. 27, 2017 (CN) ..... 2017 1 0109366

(51) Int. Cl.
*B41F 15/44* (2006.01)
*B41F 15/08* (2006.01)
*B41F 35/00* (2006.01)

(52) U.S. Cl.
CPC ..... *B41F 15/08* (2013.01); *B41F 15/44* (2013.01); *B41F 35/005* (2013.01); *B41F 35/008* (2013.01)

(58) Field of Classification Search
CPC ..... B41F 15/108; B41F 15/44; B41F 35/005; B41F 35/008; B41F 15/08
See application file for complete search history.

(56) References Cited

U.S. PATENT DOCUMENTS 5,485,781 A * 1/1996 Rovaris ..... B41F 15/0818 101/123
5,918,544 A * 7/1999 Doyle ..... B41F 35/00 101/423

(Continued)

FOREIGN PATENT DOCUMENTS

CN 103991276 A 8/2014
CN 204451535 U 7/2015

(Continued)

OTHER PUBLICATIONS

First Office Action for Chinese Patent Application No. 201710109366.6 dated May 2, 2018.

*Primary Examiner* — Jill E Culler
*Assistant Examiner* — Marissa Ferguson-Samreth
(74) *Attorney, Agent, or Firm* — Calfee, Halter & Griswold LLP

(57) ABSTRACT

The present disclosure discloses a screen printing system and a cleaning method thereof. The screen printing system has a scraper cleaning region and a working region, and the screen printing system includes a scraper and a scraper cleaning unit. The scraper operates within the working region, and the scraper cleaning unit is configured to clean the scraper. The scraper and the scraper cleaning unit are configured as follows: the scraper stays in the working region, and the scraper cleaning unit moves to a position where the scraper stays to clean the scraper; or the scraper cleaning unit is positioned in the scraper cleaning region, and the scraper moves to the scraper cleaning region, so that the scraper cleaning unit cleans the scraper.

14 Claims, 2 Drawing Sheets

(56) References Cited

U.S. PATENT DOCUMENTS

| | | | | |
|---|---|---|---|---|
| 2009/0133208 | A1* | 5/2009 | Curtin | B41F 15/44<br>15/250.31 |
| 2012/0090483 | A1* | 4/2012 | Willshere | B41F 15/0881<br>101/123 |
| 2013/0192484 | A1* | 8/2013 | Lieske | B41F 35/005<br>101/425 |
| 2014/0116274 | A1* | 5/2014 | Satou | H05K 3/1216<br>101/126 |
| 2014/0190361 | A1* | 7/2014 | Satou | H05K 3/1233<br>101/126 |
| 2015/0033966 | A1* | 2/2015 | Ong | B41F 15/12<br>101/129 |
| 2015/0090770 | A1* | 4/2015 | Mantani | B23K 3/08<br>228/102 |
| 2015/0183210 | A1* | 7/2015 | Mantani | B41F 15/0881<br>101/123 |
| 2017/0057270 | A1* | 3/2017 | Ashmore | B41F 35/005 |

FOREIGN PATENT DOCUMENTS

| | | | |
|---|---|---|---|
| CN | 205395447 | U | 7/2016 |
| CN | 205467892 | U | 8/2016 |
| CN | 106000985 | A | 10/2016 |
| CN | 106079893 | A | 11/2016 |
| DE | 20103822 | U1 | 6/2001 |
| WO | 2011026905 | A1 | 3/2011 |

* cited by examiner

SCREEN PRINTING SYSTEM AND CLEANING METHOD THEREOF

CROSS REFERENCE

This application is based upon and claims priority to Chinese Patent Application No. 201710109366.6, filed on Feb. 27, 2017, the entire contents thereof are incorporated herein by reference.

TECHNICAL FIELD

The present disclosure generally relates to the field of printing technologies, and particularly to a screen printing system. The present disclosure also relates to a cleaning method of the screen printing system.

BACKGROUND

Screen printing devices are widely used for ink printing in the industries such as panels, touch screens and so on. Screen printing generally refers to a technology where ink is coated on a screen surface, and pressure is applied to the screen surface by means of a scraper, so that the ink penetrates through screen meshes on the screen, and is squeezed out of the screen meshes and evenly printed on products, thereby forming specific patterns.

As the ink has curing characteristics, the screen meshes may be blocked after screen printing for a certain number of times. Generally, cases such as uneven printing or abnormal color may occur if the screen whose screen meshes are blocked and the scraper having coagulated residual ink are further used for producing, thus affecting the quality of the products. Therefore, in the shutdown process of the screen printing devices, it is required to timely clean the screen and the scraper surface so as to prevent residual ink from being coagulated on the screen and the scraper due to not printing for a long time.

For traditional screen printing devices, generally the screen and the scraper need to be manually scrubbed frequently using non-dust cloth, which is time-consuming and laborious. Manual cleaning is prone to omission, and thus it is difficult to ensure the cleaning effect. Therefore, poor printing processes caused by unclean scrapers and screens often occur, which has a negative effect on product yield. Besides, the ink contains harmful ingredients, and some of the ink ingredients is volatile, emitting pungent odor. Therefore, frequently manually scrubbing the screens and the scrapers in severe environments for a long time seriously affects physical and mental health.

The above-mentioned information disclosed in this Background section is only for the purpose of enhancing the understanding of background of the present disclosure and may therefore include information that does not constitute a prior art that is known to those of ordinary skill in the art.

SUMMARY

The Summary section of the present disclosure is neither intended to limit key features and essential technical features of the technical solutions requested to be protected, nor intended to determine the scope of protection of the technical solutions requested to be protected.

A major objective of the present disclosure is to overcome at least one defect of the prior art and provide a screen printing system so as to automatically clean a scraper, thereby saving labour and reducing manufacturing cost.

Another major objective of the present disclosure is to provide a screen printing system so as to automatically clean a screen, thereby saving labour and reducing manufacturing cost.

Another major objective of the present disclosure is to provide a cleaning method of the screen printing system so as to clean a scraper, thereby reducing manufacturing cost.

Another major objective of the present disclosure is to provide a cleaning method of the screen printing system so as to clean a screen, thereby reducing manufacturing cost.

In order to achieve the foregoing objectives of the present disclosure, the present disclosure adopts the following technical solutions.

According to an aspect of the present disclosure, there is provided a screen printing system, which has a scraper cleaning region and a working region. The screen printing system includes: a scraper and a scraper cleaning unit. The scraper operates within the working region, and the scraper cleaning unit is configured to clean the scraper. The scraper and the scraper cleaning unit are configured as follows: the scraper stays in the working region, and the scraper cleaning unit moves to a position where the scraper stays to clean the scraper; or the scraper cleaning unit is positioned in the scraper cleaning region, and the scraper moves to the scraper cleaning region, so that the scraper cleaning unit cleans the scraper.

According to an aspect of the present disclosure, there is provided a cleaning method of a screen printing system. The screen printing system has a scraper cleaning region and a working region, and the screen printing system includes a scraper and a scraper cleaning unit. The scraper operates within the working region, and the scraper cleaning unit is configured to clean the scraper. The cleaning method includes following steps: driving the scraper cleaning unit to move to the working region; driving the scraper cleaning unit to move on a surface of the scraper so that the scraper cleaning unit cleans the scraper; and driving the scraper cleaning unit to leave from the working region; or driving the scraper to move to the scraper cleaning region from the working region; driving the scraper cleaning unit to move on the surface of the scraper so that the scraper cleaning unit cleans the scraper; and driving the scraper to return to the working region.

BRIEF DESCRIPTION OF THE DRAWINGS

Various objectives, features and advantages of the present disclosure will become more apparent by considering the following detailed description of preferred embodiments of the present disclosure with reference to the accompanying drawings. The accompanying drawings are merely exemplary illustration of the present disclosure, and are not necessarily drawn to scale. The same reference numerals in the accompanying drawings always indicate the same or similar components. In the accompanying drawings.

Figure 1:
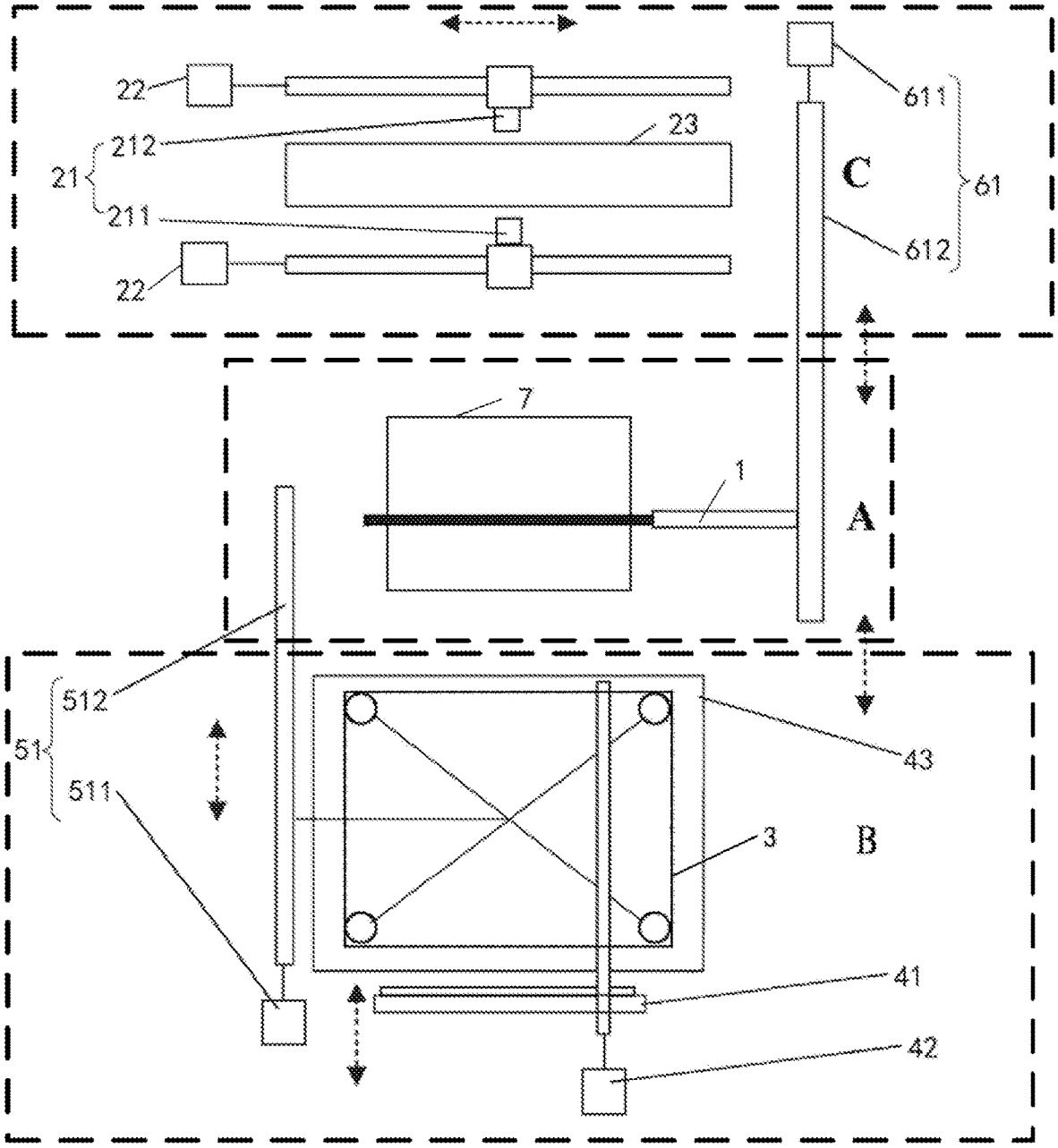
FIG. 1 is a top view of a screen printing system illustrated according to an exemplary embodiment.

Reference numerals in the accompanying drawings are as follows:

scraper 1; scraper cleaning unit 21;

first cleaning structure 211, second cleaning structure 212;

scraper cleaning and driving apparatus 22; scraper soaking tank 23;

screen 3; screen cleaning unit 41;

screen cleaning and driving apparatus 42; screen soaking tank 43;

first direction moving mechanism 51; first drive member 511;

first moving component 512; second direction moving mechanism 52;

second drive member 521; second moving component 522;

first connecting mechanism 53; third direction moving mechanism 61;

third drive member 611; third moving component 612;

fourth direction moving mechanism 62; fourth drive member 621;

fourth moving component 622; second connecting mechanism 63;

paste coating region A; screen cleaning region B;

scraper cleaning region C; avoidance position D;

scraper drying position E; scraper soaking position F;

screen drying position G; screen soaking position H;

workpiece 7; workpiece support table 8.

DETAILED DESCRIPTION

Now, exemplary embodiments will be described more comprehensively with reference to the drawings. However, the exemplary embodiments may be carried out in various manners, and shall not be interpreted as being limited to the embodiments set forth herein; instead, providing these embodiments will make the present disclosure more comprehensive and complete, and will fully convey the conception of the exemplary embodiments to those skilled in the art. Throughout the drawings, similar reference signs indicate the same or similar structures, and their detailed description will be omitted.

In case that no contrary description is made, the ordinal numerals such as "first", "second" and so on as used in the present disclosure are merely intended to better describe the present disclosure to differentiate same or similar components, and do not indicate that components limited by the ordinal numerals have a priority. Nouns of locality such as "above, beneath, left, right" as used in the present disclosure typically are defined referring to directions in the accompanying drawings.

Figure 2:
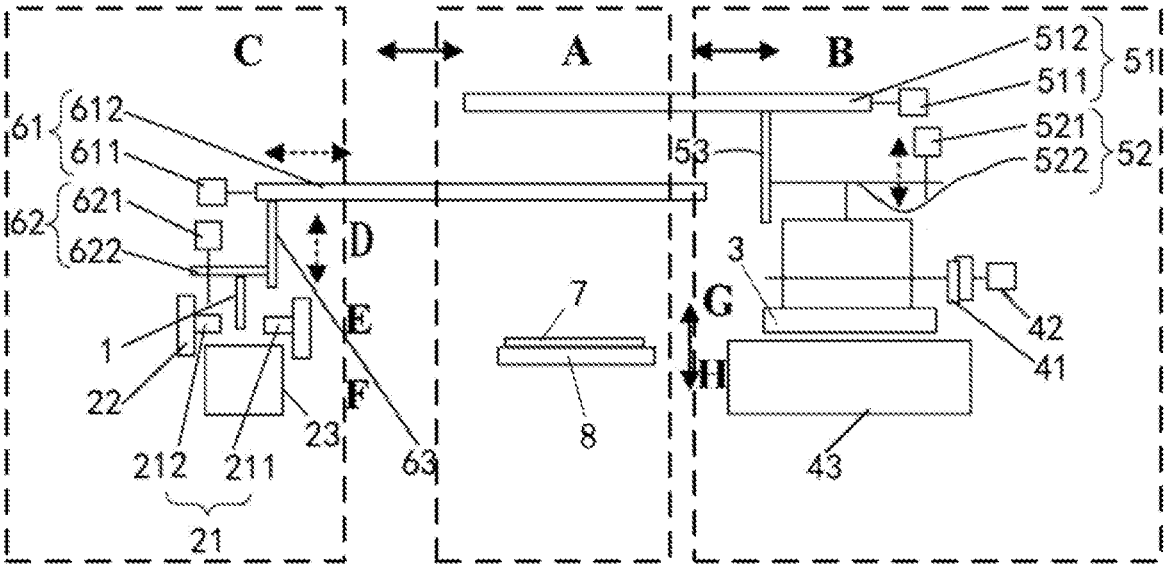
FIG. 2 is a lateral view of a screen printing system illustrated according to an exemplary embodiment.

FIG. 1 is a top view of a screen printing system illustrated according to an exemplary embodiment. FIG. 2 is a lateral view of a screen printing system illustrated according to an exemplary embodiment.

Referring to FIG. 1 and FIG. 2, according to an aspect of the present disclosure, there is provided a screen printing system, which may include a working region. When the system is in a running state, a scraper 1 and a screen 3 generally may be positioned within the working region. The working region may be, for example but not limited to, a paste coating region A. Specifically, the screen 3 has a first surface and a second surface arranged oppositely. The scraper 1 may be arranged above the first surface of the screen 3, and a to-be-printed workpiece 7 supported by a workpiece support table 8 may be arranged beneath the second surface of the screen 3. When the system runs, the scraper 1 may move on the first surface to print ink on the screen 3 onto the workpiece 7. To clean the scraper 1 and the screen 3, the screen printing system may further include a scraper cleaning region C and a screen cleaning region B. When the screen printing system is in an out-of-service state, the scraper cleaning unit 21 may clean the scraper 1, and the screen cleaning unit 41 may also clean the screen 3, which is specifically described in the following.

Further referring to FIG. 1 and FIG. 2, the screen printing system may include the scraper 1 and a scraper cleaning unit 21. The scraper 1 generally may run within the paste coating region A. According to a specific embodiment of the present disclosure, the scraper cleaning unit 21 may stop running within the scraper cleaning region C. After the scraper 1 moves to the scraper cleaning region C, the scraper cleaning unit 21 may clean the scraper 1. Specifically, when the screen printing system is in an out-of-service state, the scraper 1 can move from the paste coating region A to the scraper cleaning region C and move to a proper position of the scraper cleaning region C, for example but not limited to, a scraper drying position E, and then may drive the scraper cleaning unit 21 to move relative to the surface of the scraper 1 so that the scraper cleaning unit 21 can scrub and clean the scraper 1. After the cleaning is completed, the scraper 1 can return to the paste coating region A from the scraper cleaning region C, waiting for the screen printing system to run again.

According to another specific embodiment of the present disclosure, in case that working conditions allow, for example, the working region has enough space to accommodate the scraper cleaning unit 21 and to allow the scraper cleaning unit 21 to clean the scraper. When the screen printing system is in an out-of-service state, the scraper 1 may stay within the working region, namely the scraper 1 may stay within the paste coating region A, and the scraper cleaning unit 21 may move into the paste coating region A to clean the scraper 1. Specifically, the scraper cleaning unit 21 is driven to move to the paste coating region A, and the position of the scraper cleaning unit 21 within the paste coating region A may be determined according to the exact position of the scraper 1. The scraper cleaning unit 21 is driven to move relative to the surface of the scraper 1 so as to clean the scraper 1. After the cleaning is completed, the scraper cleaning unit 21 may be driven to leave from the paste coating region A.

Compared with traditional screen printing devices, the screen printing system provided by the present disclosure can automatically clean the scraper 1 by means of the scraper cleaning unit 21, thereby saving labour. In another aspect, manually operating in the environments containing ink for a long time is avoided, and thus physical and mental health may be improved. The scraper cleaning unit 21 provided by a specific embodiment of the present disclosure may move on the surface of the scraper 1 according to a predetermined path so that incomplete cleaning caused by omission of a certain region of the scraper 1 may be prevented, thereby improving printing technologies. In another aspect, according to a specific embodiment of the present disclosure, a cleaning frequency may be set up, so that omission of cleaning due to artificial omission may be avoided.

Further referring to FIG. 1 and FIG. 2, according to a specific embodiment of the present disclosure, the screen printing system further includes a scraper cleaning and driving apparatus 22 and a scraper soaking tank 23. The scraper cleaning and driving apparatus 22 can drive the scraper cleaning unit 21 to move on the surface of the scraper 1. Specific movement paths of the scraper cleaning unit 21 may be designed according to actual needs, which fall within the scope of protection of the present disclosure. The scraper soaking tank 23 may be configured to accommodate scraper cleaning fluid to soak the scraper 1. According to a specific embodiment of the present disclosure, the scraper soaking tank 23 can accommodate the scraper 1 so that the scraper 1 enters the scraper soaking tank 23 for soaking. To improve the cleaning speed and the cleaning effect, an installation position of the scraper soaking tank 23 may be adjusted according to actual installation needs. For example but not limited to, according to a specific embodiment of the present disclosure, the scraper soaking tank 23 may be arranged beneath the scraper cleaning unit 21.

Further referring to FIG. 1 and FIG. 2, the scraper cleaning and driving apparatus 22 may be connected to the scraper cleaning unit 21 to drive the scraper cleaning unit 21 to move on the external surface of the scraper 1 so as to clean the scraper 1. For example but not limited to, the scraper cleaning unit 21 may move on the surface of the scraper 1 along an extension direction of the scraper 1, or the scraper cleaning unit 21 may also move on the surface of the scraper 1 along an extension direction perpendicular to the scraper 1, or of course the scraper cleaning unit 21 may also move on the surface of the scraper 1 along other predetermined paths, which fall within the scope of protection of the present disclosure. According to a specific embodiment of the present disclosure, the scraper cleaning unit 21 may move on the surface of the scraper 1 along an extension direction perpendicular to the scraper 1. That is, the scraper cleaning unit 21 moves along a longitudinal direction so that the scraper cleaning fluid remained on the surface of the scraper 1 may be dropped into the scraper soaking tank 23.

Further referring to FIG. 1 and FIG. 2, according to an embodiment of the present disclosure, the scraper cleaning unit 21 may include a first cleaning structure 211 and a second cleaning structure 212 arranged oppositely to each other. The first cleaning structure 211 and the second cleaning structure 212 may be respectively movable and may be respectively connected to the scraper cleaning and driving apparatus 22 thereof, so that at least one of the first cleaning structure 211 and the second cleaning structure 212 or both can move relative to the surface of the scraper 1. The first cleaning structure 211 and the second cleaning structure 212 may have the same structure, and thus reference may be made taking the first cleaning structure 211 as an example. The first cleaning structure 211 may include a cleaning member such as a hairbrush or a soft cloth and so on. The first cleaning structure 211 may further include a drying device, for example but not limited to, the drying device may use dry compressed gas to dry the scraper 1.

Further referring to FIG. 1 and FIG. 2, according to an embodiment of the present disclosure, the screen printing system may further include a screen 3 and a screen cleaning unit 41. The screen 3 may include a first surface, and the scraper 1 can move on the first surface. The screen cleaning unit 41 may move relative to the screen 3.

Further referring to FIG. 1 and FIG. 2, according to a specific embodiment of the present disclosure, for example but not limited to, the screen 3 generally may run within the paste coating region A. In case that the screen 3 needs to be cleaned, the screen 3 may move from the paste coating region A to the screen cleaning region B. In the screen cleaning region B, a screen cleaning unit 41 may be arranged. After the screen 3 enters a proper position, for example but not limited to a screen drying position G The screen cleaning unit 41 may move relative to the screen 3 to scrub and clean the screen 3.

According to another specific embodiment of the present disclosure, in case that working conditions allow, for example, the working region has enough space to accommodate the screen cleaning unit 41 and can allow the screen cleaning unit 41 to clean the scraper. When the screen printing system is in an out-of-service state, the screen 3 may stay within the paste coating region A, and the screen cleaning unit 41 is driven to enter the paste coating region A and move to a proper position so as to clean the screen 3. After the cleaning is completed, the screen cleaning unit 41 may be driven to leave from the paste coating region A.

Further referring to FIG. 1 and FIG. 2, according to an embodiment of the present disclosure, the screen printing system may further include a screen cleaning and driving apparatus 42 and a screen soaking tank 43. The screen cleaning and driving apparatus 42 can drive the screen cleaning unit 41 to move so that the screen cleaning unit 41 can move relative to the first surface of the screen 3 or a surface in parallel with the first surface to clean the screen 3. Specific movement paths of the screen cleaning unit 41 may be designed according to actual needs, which fall within the scope of protection of the present disclosure. The screen soaking tank 43 is configured to accommodate screen cleaning fluid to soak the screen 3. According to a specific embodiment of the present disclosure, the screen soaking tank 43 can accommodate the screen 3 so that the screen 3 enter the screen soaking tank 43 for soaking. To improve the cleaning speed and the cleaning effect, an installation position of the screen soaking tank 43 may be adjusted according to actual installation needs. For example but not limited to, according to a specific embodiment of the present disclosure, the screen soaking tank 43 may be arranged beneath the screen cleaning unit 41.

The screen cleaning and driving apparatus 42 may be connected to the screen cleaning unit 41 to drive the screen cleaning unit 41 to move on the first surface of the screen 3 so as to clean the screen 3. For example but not limited to, the screen cleaning unit 41 may transversely move on the first surface of the screen 3 or may longitudinally move on the first surface of the screen 3, or of course move on the first surface of the screen 3 along other predetermined paths, which fall within the scope of protection of the present disclosure.

According to an embodiment of the present disclosure, the screen cleaning unit 41 may be connected to the screen cleaning and driving apparatus 42 to drive the screen cleaning unit 41 to clean the screen 3. The screen cleaning unit 41 may include a cleaning member such as a hairbrush or a soft cloth and so on. The screen cleaning unit 41 may further include a screen drying device, for example but not limited to, the screen drying device may use dry compressed gas to dry the screen 3. After the screen cleaning member cleans the screen 3, the screen drying device may dry the screen 3. The screen cleaning member and/or the screen drying device can move within a surface in parallel with the first surface to clean the first surface and the second surface of the screen 3.

Further referring to FIG. 1 and FIG. 2, according to an embodiment of the present disclosure, the screen printing system further includes a screen moving mechanism, which may include a first direction moving mechanism 51, a second direction moving mechanism 52 and a first connecting mechanism 53. The first direction moving mechanism 51 may include a first drive member 511 and a first moving component 512, the first moving component being a worm and gear assembly, a rack and pinion assembly, a sprocket and chain assembly, or a connecting rod assembly. Driven by the first drive member 511, the first moving component 512 may move along the first direction. According to a specific embodiment of the present disclosure, the first direction may be denoted by a double arrow between the paste coating region A and the screen cleaning region B. However, the present disclosure is not limited thereto.

The second direction moving mechanism 52 may include a second drive member 521 and a second moving component 522, the second moving component being a worm and gear assembly, a rack and pinion assembly, a sprocket and chain assembly, or a connecting rod assembly. Driven by the second drive member 521, the second moving component 522 may move along a second direction. According to a specific embodiment of the present disclosure, the second direction may be denoted by a double arrow between a screen drying position G and a screen soaking position H. However, the present disclosure is not limited thereto. According to a specific embodiment of the present disclosure, the first direction may be perpendicular to the second direction, but the present disclosure is not limited thereto. The moving directions of the first moving component 512 and the second moving component 522 may be set up according to specific paths of the screen 3.

The first connecting mechanism 53 may be fixed to either one of the first moving component 512 and the second moving component 522. The first connecting mechanism 53 may include a first guide member, wherein an extension direction of the first guide member is the same as a moving direction of the other one of the first moving component 512 and the second moving component 522. The screen 3 may be fixed to the other one of the first moving component 512 and the second moving component 522. Specifically, according to a specific embodiment of the present disclosure, the first connecting mechanism 53 may be fixedly arranged on the first moving component 512, and the extension direction of the first guide member of the first connecting mechanism 53 may be perpendicular to that of the first moving component 512. For example but not limited to, the first moving component 512 may be a cylinder, and the first guide member may extend along a radial direction of the first moving component 512. The extension direction of the second moving component 522 may be parallel to that of the first moving component 512. More specifically, one end of the second moving component 522 may slide in the first guide member. According to a specific embodiment of the present disclosure, the screen 3 may be fixed to the second moving component 522. According to a specific embodiment of the present disclosure, the first direction may be perpendicular to the second direction. According to a specific embodiment of the present disclosure, the first moving component 512 and/or the second moving component 522 may be a worm and gear assembly, or a rack and pinion assembly, or a sprocket and chain assembly, or a connecting rod assembly or other mobile components conceivable to those skilled in the art, which fall within the scope of protection of the present disclosure. According to a specific embodiment of the present disclosure, the first guide member may be a guide rail.

Further referring to FIG. 1 and FIG. 2, according to an embodiment of the present disclosure, the screen printing system may further include a scraper moving mechanism, which includes a third direction moving mechanism 61, a fourth direction moving mechanism 62 and a second connecting mechanism 63. The third direction moving mechanism 61 may include a third drive member 611 and a third moving component 612, the third moving component being a worm and gear assembly, a rack and pinion assembly, a sprocket and chain assembly, or a connecting rod assembly. Driven by the third drive member 611, the third moving component 612 moves along a third direction. According to a specific embodiment of the present disclosure, the third direction may be denoted by a double arrow between the paste coating region A and the scraper cleaning region C.

The fourth direction moving mechanism 62 includes a fourth drive member 621 and a fourth moving component 622, the fourth moving component being a worm and gear assembly, a rack and pinion assembly, a sprocket and chain assembly, or a connecting rod assembly. Driven by the fourth drive member 621, the fourth moving component 622 moves along a fourth direction. According to a specific embodiment of the present disclosure, the fourth direction may be denoted by a double arrow between an avoidance position D and a scraper soaking position F. However, the present disclosure is not limited thereto. According to a specific embodiment of the present disclosure, the third direction may be perpendicular to the fourth direction, but the present disclosure is not limited thereto. The moving directions of the third moving component 612 and the fourth moving component 622 may be set up according to specific paths of the scraper 1.

The second connecting mechanism 63 may be fixed to either one of the third moving component 612 and the fourth moving component 622. The second connecting mechanism 63 includes a second guide member, wherein the extension direction of the second guide member is the same as the moving direction of the other one of the third moving component 612 and the fourth moving component 622. The scraper 1 may be fixed to the other one of the third moving component 612 and the fourth moving component 622. Specifically, according to a specific embodiment of the present disclosure, the second connecting mechanism 63 may be fixedly arranged on the third moving component 612, and the extension direction of the second guide member of the second connecting mechanism 63 may be perpendicular to that of the third moving component 612. For example but not limited to, the third moving component 612 may be a cylinder, and the second guide member may extend along a radial direction of the third moving component 612. The extension direction of the fourth moving component 622 may be parallel to that of the third moving component 612. More specifically, one end of the fourth moving component 622 may slide in the second guide member. According to a specific embodiment of the present disclosure, the scraper 1 may be fixed to the fourth moving component 622. According to a specific embodiment of the present disclosure, the second guide member may be a guide rail.

According to an embodiment of the present disclosure, the third moving component 612 and/or the fourth moving component 622 may be a worm and gear assembly, or a rack and pinion assembly, or a sprocket and chain assembly, or a connecting rod assembly or other mobile components conceivable to those skilled in the art, which fall within the scope of protection of the present disclosure.

The first drive member 511, the second drive member 521, the third drive member 611 or the fourth drive member 621 provided by the present disclosure may be a drive motor or other drive members, which fall within the scope of protection of the present disclosure.

According to an aspect of the present disclosure, there is provided a cleaning method of a screen printing system. The screen printing system is the screen printing system provided by the present disclosure, and the cleaning method may include following steps.

driving the scraper cleaning unit 21 to move to the working region; driving the scraper cleaning unit 21 to move on the surface of the scraper 1 so that the scraper cleaning unit 21 cleans the scraper 1; driving the scraper cleaning unit 21 to leave from the working region; or driving the scraper 1 to move to the scraper cleaning region C from the working region; driving the scraper cleaning unit 21 to move on the surface of the scraper 1 so that the scraper cleaning unit 21 cleans the scraper 1; and driving the scraper 1 to return to the working region.

According to an embodiment of the present disclosure, the cleaning method may further include the following steps: driving the screen cleaning unit 41 to move to the working region; driving the screen cleaning unit 41 to move on the screen 3 so that the screen cleaning unit 41 cleans the screen 3; driving the screen cleaning unit 41 to leave from the working region; or driving the screen 3 to move to the screen cleaning region 41 from the working region; driving the screen cleaning unit 41 to move on the screen 3 so that the screen cleaning unit 41 cleans the screen 3; and driving the screen 3 to return to the working region.

Specifically, according to a specific embodiment of the present disclosure, cleaning processes of the scraper 1 may be as below: the scraper 1 generally may run in the paste coating region A. In case that it is required to clean, namely when the screen printing system is in an out-of-service state, the third drive member 611 may drive the third moving component 612 to move along a third direction. The third direction may be a transverse direction such as a left direction in FIG. 2. The scraper 1 may move to the scraper cleaning region C from the paste coating region A; then the fourth drive member 621 may drive the fourth moving component 622 to move along a fourth direction. The fourth direction may be a longitudinal direction such as a downward direction in FIG. 2. In this way, the scraper 1 moves to a scraper soaking position F along a direction toward the scraper soaking tank 23 so that the scraper 1 can be soaked in the scraper soaking tank 23. After being soaked for appropriate time, the fourth drive member 621 may drive the fourth moving component 622 to move along an upward direction to drive the scraper 1 to move to the scraper drying position E from the scraper soaking position F. At this moment, driven by the driving apparatus, the scraper cleaning unit 21 positioned within this region may move relative to the surface of the scraper 1 to clean the scraper 1. After the scraper 1 is cleaned, the third drive member 611 and the fourth drive member 621 may respectively drive the third moving component 612 and the fourth moving component 622 to move along two opposite directions so that the scraper 1 returns to the paste coating region A again.

According to another specific embodiment of the present disclosure, cleaning processes of the screen 3 may be as below: the screen 3 generally may run in the paste coating region A. In case that it is required to clean, namely when the screen printing system is in an out-of-service state, the first drive member 511 may drive the first moving component 512 to move along a first direction. The first direction may be a transverse direction such as a right direction in FIG. 2. The screen 3 may move to the screen cleaning region B from the paste coating region A; then the second drive member 521 may drive the second moving component 522 to move along a second direction. The second direction may be a longitudinal direction such as a downward direction in FIG. 2. In this way, the screen 3 moves to the screen soaking position H along a direction toward the screen soaking tank 43 so that the screen 3 can be soaked in the screen soaking tank 43. After being soaked for appropriate time, the second drive member 521 may drive the second moving component 522 to move along an upward direction to drive the screen 3 to move to the screen drying position G from the screen soaking position H. At this moment, driven by the driving apparatus, the screen cleaning unit 41 positioned within this region may move relative to the first surface of the screen 3 to clean the screen 3. After the screen 3 is cleaned, the first drive member 511 and the second drive member 521 may respectively drive the first moving component 512 and the second moving component 522 to move along two opposite directions so that the screen 3 returns to the paste coating region A again.

According to a specific embodiment of the present disclosure, in the scraper soaking tank 23 there may be also provided with a scraper cleaning fluid circulation flow apparatus, a scraper cleaning fluid concentration detector, and a scraper cleaning fluid automatic supply apparatus. All adjustments made by those skilled in the art according to actual operational needs within the spirit scope of the present disclosure fall within the scope of protection of the present disclosure. Similarly, in the screen soaking tank 23 there may be also provided with a screen cleaning fluid circulation flow apparatus, a screen cleaning fluid concentration detector, and a screen cleaning fluid automatic supply apparatus, which are not unnecessarily elaborated any more herein.

According to a specific embodiment of the present disclosure, scraper cleaning period, scraper soaking time and scraper cleaning and drying parameters may be preset according to characteristics of ink materials and the scraper cleaning fluid. After the cleaning period is reached, the scraper 1 may automatically move to the avoidance position D, the scraper 1 drops to the scraper soaking position F along a vertical direction, so that the scraper 1 is soaked in the soaking tank. After the preset soaking time is reached, the scraper 1 moves, upward along the vertical direction, to the scraper drying position E, and the scraper cleaning unit 21 cleans and dries the scraper 1. In this way, functions of automatically cleaning and drying remnant materials on the surface of the scraper 1 are implemented.

According to a specific embodiment of the present disclosure, screen cleaning period, screen soaking time and screen cleaning and drying parameters may be preset according to characteristics of ink materials and the scraper cleaning fluid. After the cleaning period is reached, the screen 3 automatically moves to the screen drying position and the screen 3 drops, along the vertical direction, to the screen soaking tank 43 and is soaked therein. After the preset soaking time is reached, the screen moves, upward along the vertical direction, to the screen drying position G The screen cleaning unit and a drying apparatus may move along a transverse direction to clean and dry the screen 3. In this way, functions of automatically cleaning and drying remnant materials on the surface of the screen 3 are implemented.

As can be seen from the above technical solutions, the screen printing system and the cleaning method of the screen printing system provided by the present disclosure have the following advantages and positive effects: the screen printing system includes a scraper cleaning unit that can move relative to the scraper; and when the scraper is in a preset position, the scraper cleaning unit may automatically clean the scraper, thereby saving labour. More further, the screen printing system further includes a screen cleaning unit that can move relative to the screen; and when the screen is in a preset position, the screen cleaning unit may automatically clean the screen, thereby saving labour.

The features, structures or characteristics described in the present disclosure may be combined in any suitable manner in one or more embodiments. Many concrete details are provided in the above descriptions to fully understand the embodiments of the present disclosure. However, those skilled in the art will realize that the technical solution for practice of the present disclosure has no one or even more the specific details, or other methods, components, materials and the like may be used. In other circumstances, well-known structures, materials or operations are not shown or described in detail to avoid confusion of respective aspects of the present disclosure.

What is claimed is:

1. A screen printing system, having a scraper cleaning region and a working region, the screen printing system comprising:

a scraper, operating within the working region;

a screen cleaning region, a screen, configured to match with the scraper in the working region to perform screen printing;

a screen cleaning unit, configured to clean the screen;

wherein the screen and the screen cleaning unit are configured as follows:

the screen stays in the working region, and the screen cleaning unit moves to a position where the screen stays to clean the screen; or the screen cleaning unit is positioned in the screen cleaning region, and the screen moves to the screen cleaning region, so that the screen cleaning unit cleans the screen;

a scraper cleaning unit, configured to clean the scraper;

wherein the scraper and the scraper cleaning unit are configured as follows:

the scraper stays in the working region, and the scraper cleaning unit moves to a position where the scraper stays to clean the scraper; or wherein the scraper cleaning unit is positioned in the scraper cleaning region, and the scraper moves to the scraper cleaning region, so that the scraper cleaning unit cleans the scraper;

a screen moving mechanism, the screen moving mechanism comprises:

a first direction moving mechanism, comprising a first drive member and a first moving component, driven by the first drive member, the first moving component moving along a first direction;

a second direction moving mechanism, comprising a second drive member and a second moving component, driven by the second drive member, the second moving component moving along a second direction;

a first connecting mechanism, fixed to one of the first moving component and the second moving component and comprising a first guide member, an extension direction of the first guide member being the same as a moving direction of the other one of the first moving component and the second moving component; and the screen is fixed to the other one of the first moving component and the second moving component.

2. The screen printing system according to claim 1 further comprising:

a scraper cleaning and driving apparatus, connected to the scraper cleaning unit and configured to drive the scraper cleaning unit to move; and a scraper soaking tank, positioned in the scraper cleaning region, accommodating scraper cleaning fluid and configured to soak and clean the scraper.

3. The screen printing system according to claim 2, wherein the scraper cleaning unit comprises a first cleaning structure and a second cleaning structure arranged oppositely to each other; and the first cleaning structure and the second cleaning structure are connected to the scraper cleaning and driving apparatus, so that at least one of the first cleaning structure and the second cleaning structure can move relative to the scraper to physically clean a surface of the scraper.

4. The screen printing system according to claim 1 further comprising a screen cleaning and driving apparatus and a screen soaking tank positioned in the screen cleaning region, and the screen cleaning and driving apparatus is connected to the screen cleaning unit and is configured to drive the screen cleaning unit to move; and the screen soaking tank accommodates screen cleaning fluid and is configured to soak and clean the screen.

5. The screen printing system according to claim 4, wherein the screen cleaning unit comprises a screen cleaning member and/or a screen drying member, the screen cleaning member and/or the screen drying member can move within a working plane in parallel with the screen to physically clean the screen.

6. The screen printing system according to claim 1, wherein the first direction is perpendicular to the second direction.

7. The screen printing system according to claim 1, wherein the first moving component is a worm and gear assembly, a rack and pinion assembly, a sprocket and chain assembly, or a connecting rod assembly.

8. The screen printing system according to claim 1 further comprising a scraper moving mechanism, and the scraper moving mechanism comprises:

a third direction moving mechanism, comprising a third drive member and a third moving component, driven by the third drive member, the third moving component moving along a third direction;

a fourth direction moving mechanism, comprising a fourth drive member and a fourth moving component, driven by the fourth drive member, the fourth moving component moving along a fourth direction; and a second connecting mechanism, fixed to one of the third moving component and the fourth moving component and comprising a second guide member, an extension direction of the second guide member being the same as a moving direction of the other one of the third moving component and the fourth moving component;

the scraper is fixed to the other one of the third moving component and the fourth moving component.

9. The screen printing system according to claim 8, wherein the third direction is perpendicular to the fourth direction.

10. The screen printing system according to claim 8, wherein the third moving component is a worm and gear assembly, a rack and pinion assembly, a sprocket and chain assembly, or a connecting rod assembly.

11. The screen printing system according to claim 1, wherein the second moving component is a worm and gear assembly, a rack and pinion assembly, a sprocket and chain assembly, or a connecting rod assembly.

12. The screen printing system according to claim 8, wherein the fourth moving component is a worm and gear assembly, a rack and pinion assembly, a sprocket and chain assembly, or a connecting rod assembly.

13. A cleaning method of a screen printing system, the screen printing system having a scraper cleaning region and a working region and comprising:

a scraper, operating within the working region; and a scraper cleaning unit, configured to clean the scraper;

wherein a scraper cleaning method comprises following steps:

driving the scraper cleaning unit to move to the working region;

driving the scraper cleaning unit to move on a surface of the scraper so that the scraper cleaning unit cleans the scraper; and driving the scraper cleaning unit to leave from the working region; or driving the scraper to move to the scraper cleaning region from the working region;

driving the scraper cleaning unit to move on the surface of the scraper so that the scraper cleaning unit cleans the scraper; and driving the scraper to return to the working region;

the screen printing system further having a screen cleaning region, a screen, configured to match with the scraper in the working region to perform screen printing;

a screen cleaning unit, configured to clean the screen;

wherein a screen cleaning method comprises the following steps:

the screen staying in the working region, and driving the screen cleaning unit to a position where the screen stays to clean the screen; or driving the screen cleaning unit to be positioned in the screen cleaning region, and driving the screen to the screen cleaning region, so that the screen cleaning unit cleans the screen;

the screen printing system further having a screen moving mechanism, the screen moving mechanism comprises a first direction moving mechanism, comprising a first drive member and a first moving component, driven by the first drive member, a second direction moving mechanism, comprising a second drive member and a second moving component, driven by the second drive member, a first connecting mechanism, fixed to one of the first moving component and the second moving component and comprising a first guide member, an extension direction of the first guide member being the same as a moving direction of the other one of the first moving component and the second moving component, the screen is fixed to the other one of the first moving component and the second moving component, wherein a screen moving method comprises the following steps:

driving the first moving component along a first direction; and driving the second moving component along a second direction.

14. The cleaning method of the screen printing system according to claim 13, wherein the screen printing system further has a screen cleaning region and further comprises a screen and a screen cleaning unit; the screen comprises a first surface; the scraper can move relative to the first surface; the screen operates in the working region; and the cleaning method further comprises following steps:

driving the screen cleaning unit to move to the working region;

driving the screen cleaning unit to move on the screen so that the scraper cleaning unit cleans the screen; and driving the screen cleaning unit to leave from the working region; or driving the screen to move to the screen cleaning region from the working region;

driving the screen cleaning unit to move on the screen so that the scraper cleaning unit cleans the screen; and driving the screen to return to the working region.

* * * * *